US011285593B2

(12) United States Patent
Wang

(10) Patent No.: US 11,285,593 B2
(45) Date of Patent: Mar. 29, 2022

(54) ELECTRIC STAPLER

(71) Applicant: APEX MFG. CO., LTD., Taichung (TW)

(72) Inventor: Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 51 days.

(21) Appl. No.: 16/866,846

(22) Filed: May 5, 2020

(65) Prior Publication Data

US 2021/0347027 A1 Nov. 11, 2021

(51) Int. Cl.
*B25C 5/15* (2006.01)
*B25C 5/02* (2006.01)

(52) U.S. Cl.
CPC ..... *B25C 5/15* (2013.01); *B25C 5/0285* (2013.01)

(58) Field of Classification Search
CPC ..... B25C 5/15; B25C 5/0285
See application file for complete search history.

(56) References Cited

U.S. PATENT DOCUMENTS 4,121,745 A * 10/1978 Smith ..... B25C 1/06 227/8
4,129,240 A * 12/1978 Geist ..... B25C 1/06 227/131
4,189,080 A * 2/1980 Smith ..... B25C 1/06 227/8
4,483,474 A * 11/1984 Nikolich ..... B25C 1/008 123/46 SC
6,722,547 B1 * 4/2004 Wang ..... B25C 1/008 173/170
7,004,367 B1 * 2/2006 Shen ..... B25C 1/008 173/170
7,159,322 B2 * 1/2007 Sasaki ..... A01G 3/053 30/216
7,389,901 B2 * 6/2008 Cho ..... B25C 1/008 227/120
7,513,402 B2 * 4/2009 Miyashita ..... B25C 1/06 227/131
8,550,323 B2 * 10/2013 Fujimoto ..... B25C 1/06 227/132
8,813,733 B2 * 8/2014 Tamura ..... B27B 17/0008 123/630
9,259,832 B2 * 2/2016 Miyazawa ..... B25F 5/02
9,978,541 B2 * 5/2018 Mizutani ..... B25F 5/00
(Continued)

*Primary Examiner* — Thomas M Wittenschlaeger
*Assistant Examiner* — Katie L Gerth
(74) *Attorney, Agent, or Firm* — Muncy, Geissler, Olds & Lowe, P.C.

(57) ABSTRACT

An electric stapler includes a main body, a handle, a striking assembly, and a safety mechanism between the main body and the handle. The handle is movable with respect to the main body between an original position and an unlock position. The striking assembly includes a striking mechanism for striking the staple out and a trigger switch on the handle for triggering the striking mechanism. The trigger switch has a strikable state and a locking state. When the handle is at the original position, the safety mechanism is at a locking mode to make the trigger switch at the locking state. When the handle is at the unlock position, the safety mechanism is at an unlock mode to make the trigger switch at the strikable state. An angle between the moving direction of the handle and the striking direction is smaller than 90 degrees.

10 Claims, 6 Drawing Sheets

(56) References Cited

U.S. PATENT DOCUMENTS

| | | | | |
|---|---|---|---|---|
| 11,044,853 | B2 * | 6/2021 | Kamiya | A01G 3/053 |
| 2005/0082334 | A1 * | 4/2005 | Hu | B25C 1/06 227/131 |
| 2009/0104861 | A1 * | 4/2009 | Van Der Linde | G05G 5/06 451/344 |
| 2012/0043364 | A1 * | 2/2012 | Coleman, Jr. | B25C 1/043 227/8 |
| 2012/0317821 | A1 * | 12/2012 | Tsuchiya | B25F 5/02 30/196 |
| 2013/0023189 | A1 * | 1/2013 | Numata | B23Q 11/0092 451/344 |
| 2014/0190713 | A1 * | 7/2014 | Martinsson | A01G 3/086 173/20 |
| 2016/0167210 | A1 * | 6/2016 | Beck | B25C 1/06 29/432 |
| 2018/0207777 | A1 * | 7/2018 | Cheatham | B25C 1/008 |
| 2020/0030954 | A1 * | 1/2020 | Wolf | B25C 1/06 |

* cited by examiner

ELECTRIC STAPLER

BACKGROUND OF THE INVENTION

Field of the Invention

The present invention relates to an electric stapler, more especially to an electric stapler having safety mechanism.

Description of the Prior Art

Normal staplers include mechanical staplers and electric staplers. The electric staplers are easier to strike the staple out than the mechanical staplers, but the force of striking of the electric staplers is also much higher than the mechanical staplers. Thus, the electric staplers are more dangerous.

To improve the safety, safety mechanism is usually included in the electric stapler. A common safety mechanism is a two-stage trigger button. When the trigger button is pressed at the first stage, a resistance from the trigger button can inform the user that the striking mechanism has been unlocked. The user has to exert larger force to strike the staple out. Thus, accidentally striking is prevented. Another safety mechanism shown in patent TW 303772 has a safety button beside the trigger button. The trigger button can be triggered only when the safety button is unlocked.

However, the safety mechanisms mentioned above have some disadvantages. First, accidentally striking cannot be prevented because the trigger button is closed to the safety button, or the trigger button and the safety button are the same button. Second, when the trigger button and the safety button are pressed at the same time by other objects, the staple may be struck out accidentally. Third, if the safety button is designed to be difficult to unlock, the stapler becomes inconvenient to use.

SUMMARY OF THE INVENTION

The main object of the present invention is to provide an electric stapler which is able to prevent from accidently striking. In addition, the user can be informed whether the stapler is strikable or not.

To achieve the above and other objects, an electric stapler of the present invention includes a main body, a handle, a power mechanism, a striking assembly, and a safety mechanism.

The main body has a receiving space and a staple outlet. The receiving space communicates the staple outlet. The receiving space is adapted for receiving at least one staple. The handle is connected to the main body. The handle has a moving portion. The moving portion is movable between an original position and an unlock position with respect to the main body. The moving portion is located at the original position normally. The power mechanism is disposed on one of the main body and the handle. The striking assembly includes a striking mechanism and a trigger switch. The striking mechanism is arranged in the receiving space and is electrically connected to the power mechanism. The striking mechanism is adapted for striking the at least one staple out along a striking direction via the staple outlet. The trigger switch is arranged on the handle and is electrically connected to the striking mechanism to trigger the striking mechanism to strike the at least one staple. The striking mechanism has a strikable state and a locking state. The trigger switch is striggerable to drive the striking mechanism to strike the at least one staple out when the trigger switch is at the strikable state, and the trigger switch is deactivated to be unable to strike the at least one staple out when the trigger switch is at the locking state. The safety mechanism is arranged between the main body and the moving portion of the handle. The safety mechanism is electrically connected to the trigger switch. The safety mechanism is at a locking mode to make the trigger switch at the locking state when the moving portion of the handle is at the original position. The safety mechanism is at an unlock mode to make the trigger switch at the strikable state when the moving portion of the handle is at the unlock positon. A direction from the original position toward the unlock position is defined as a moving direction, and an angle between the moving direction and the striking direction is smaller than 90 degrees.

To achieve the above and other objects, an electric stapler of the present invention includes a main body, a handle, a power mechanism, a striking assembly, and a safety mechanism.

The main body has a receiving space and a staple outlet. The receiving space communicates the staple outlet. The receiving space is adapted for receiving at least one staple. The handle is connected to the main body. The handle has a moving portion. The moving portion is movable between an original position and an unlock position with respect to the main body. The moving portion is located at the original position normally. The power mechanism is disposed on one of the main body and the handle. The striking assembly includes a striking mechanism and a trigger switch. The striking mechanism is arranged in the receiving space and is electrically connected to the power mechanism. The striking mechanism is adapted for striking the at least one staple out along a striking direction via the staple outlet. The trigger switch is arranged on the moving portion of the handle and is electrically connected to the striking mechanism to trigger the striking mechanism to strike the at least one staple. The striking mechanism has a strikable state and a locking state. The trigger switch is striggerable to drive the striking mechanism to strike the at least one staple out when the trigger switch is at the strikable state. The trigger switch is deactivated to be unable to strike the at least one staple out when the trigger switch is at the locking state. The safety mechanism is arranged on the handle. The safety mechanism is electrically connected to the trigger switch. The safety mechanism has a locking mode and an unlock mode. The trigger switch is at the locking state when the safety mechanism is at the locking mode, and the trigger switch is at the strikable state when the safety switch is at the unlock mode. When the moving portion of the handle is at the striking position and the trigger switch is at the strikable state, the trigger switch drives the striking mechanism to strike the at least one staple out. A direction from the original position toward the unlock position is defined as a moving direction, and an angle between the moving direction and the striking direction is smaller than 90 degrees.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
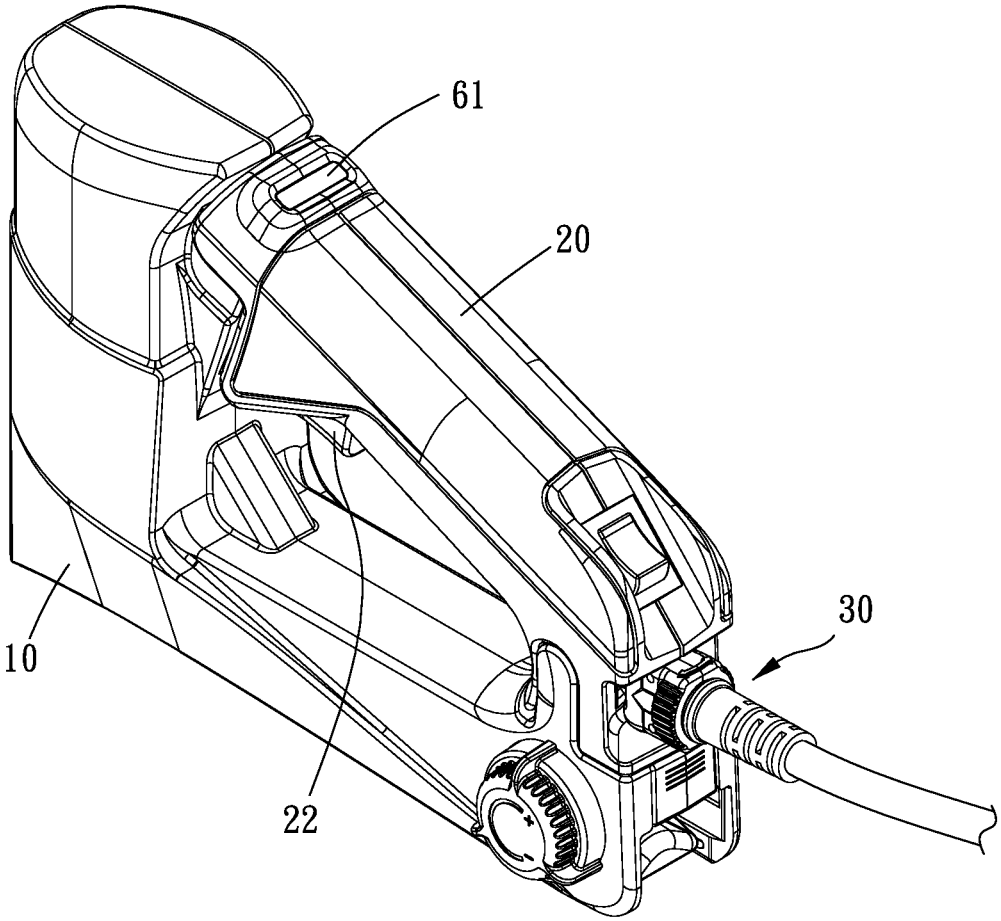
FIG. 1 is a stereogram of the present invention.
Figure 2:
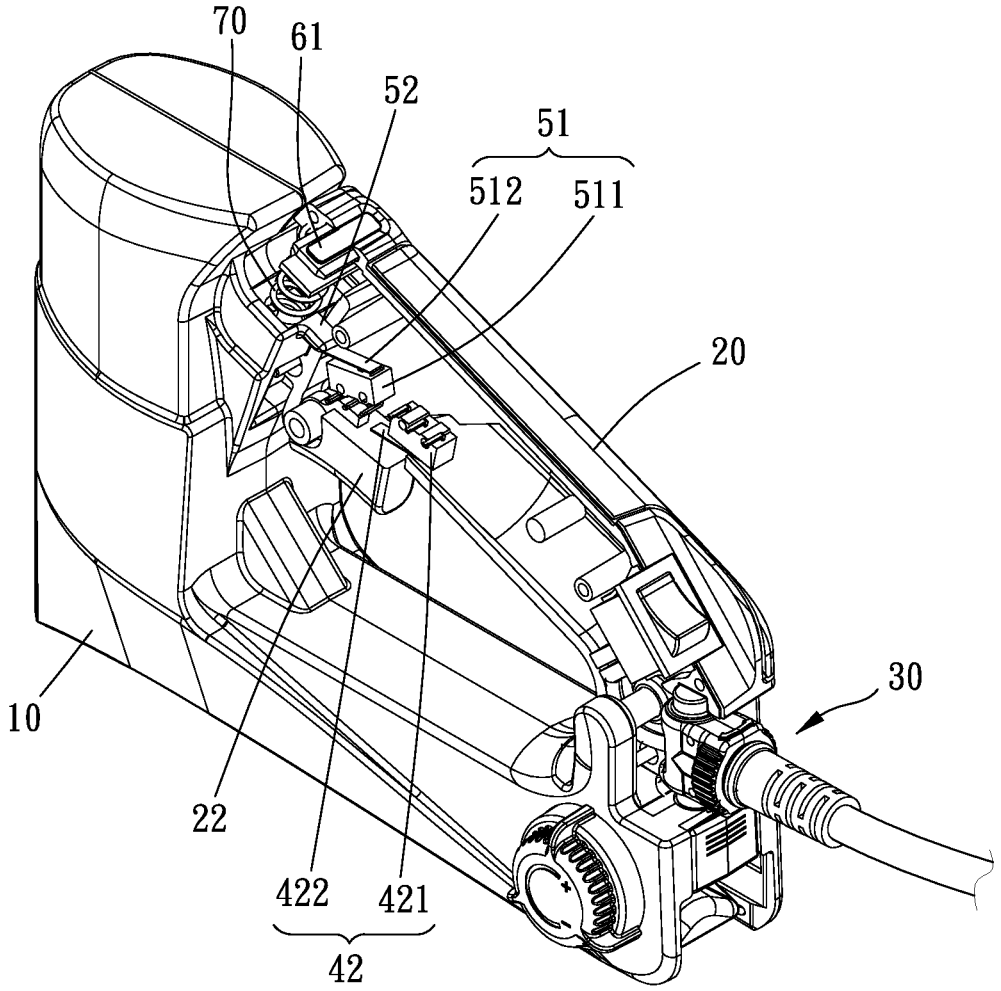
FIG. 2 is a partially perspective drawing of the present invention.
Figure 3:
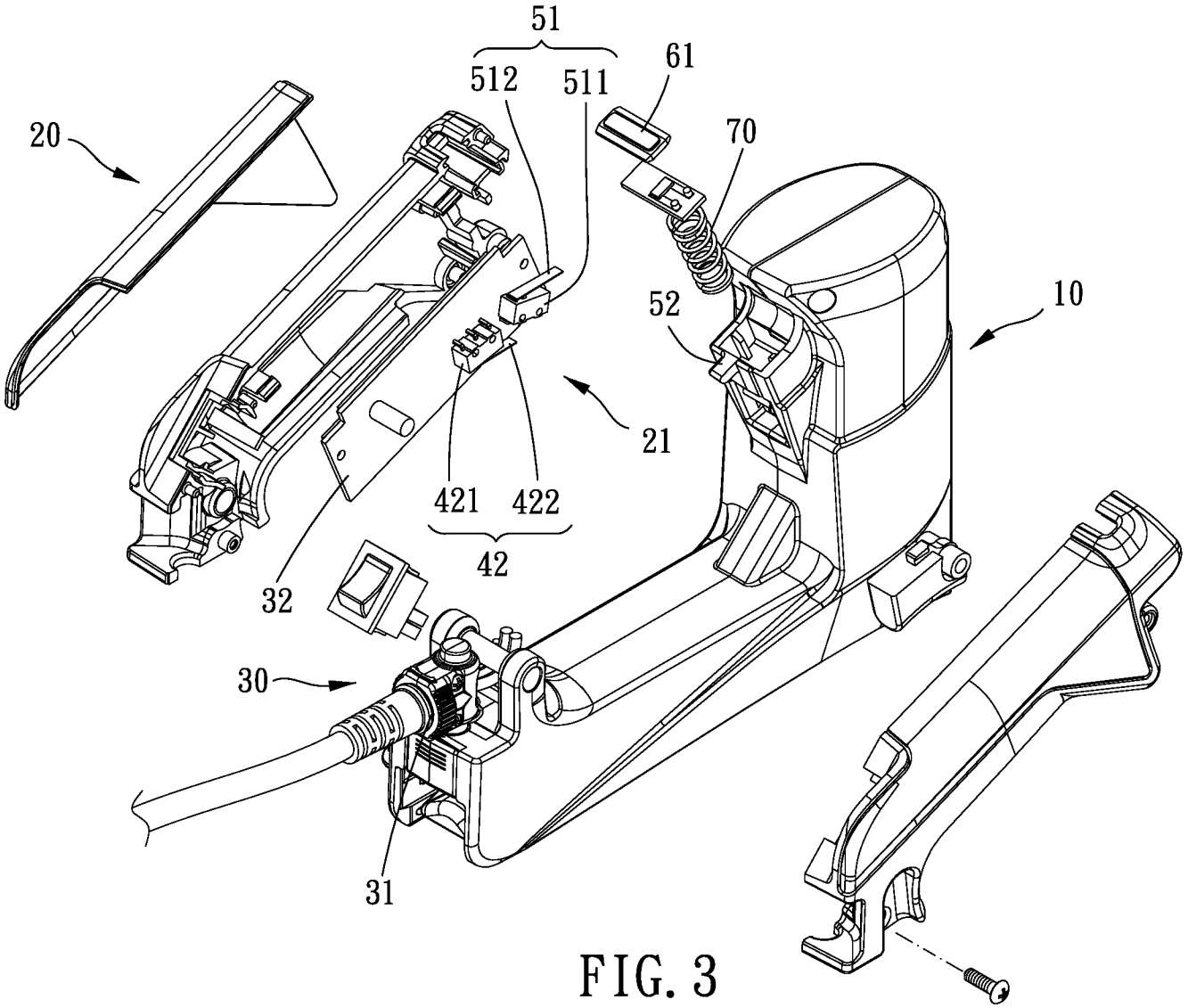
FIG. 3 is a breakdown drawing of the present invention.

Please refer to FIG. 1 to FIG. 6, the electric stapler of the present invention includes a main body 10, a handle 20, a power mechanism 30, a striking assembly, and a safety mechanism.

The main body 10 has a receiving space 11 and a staple outlet 12. The receiving space 11 communicates the staple outlet 12. The receiving space 11 is adapted for receiving at least one staple. The handle 20 is connected to the main body 10 and has a moving portion 21 which is movable between an original position and an unlock position with respect to the main body 10. The moving portion 21 is normally at the original position. In the present embodiment, a spring 70 is biased between the main body 10 and the handle 20 to make the handle 20 at the original position normally. The power mechanism 30 is disposed on one of the main body 10 and the handle 20. The striking assembly includes a striking mechanism 41 and a trigger switch 42. The striking mechanism 41 is arranged in the receiving space 11 of the main body 10 and is electrically connected to the power mechanism 30 to strike the at least one staple along a striking direction S via the staple outlet 12. The trigger switch 42 is disposed on the handle 20 and is electrically connected to the striking mechanism to drive the striking mechanism 41 to strike the at least one staple out. The trigger switch 42 has a strikable state and a locking state. When the trigger switch 42 is at the strikable state, the trigger switch 42 is triggerable to drive the striking mechanism 41 to strike the at least one staple out. When the trigger switch 42 is at the locking state, the trigger switch 42 is not activated so that the trigger switch 42 is unable to be triggered. The safety mechanism is arranged between the main body 10 and the moving portion 21 of the handle 20 and is electrically connected to the trigger switch 42. When the moving portion 21 of the handle 20 is at the original position, the safety mechanism is at a locking mode to make the trigger switch 42 at the locking state. When the moving portion 21 of the handle 20 is at the unlock position, the safety mechanism is at an unlock mode to make the trigger switch 42 at the strikable state. A direction from the original position toward the unlock position is defined as a moving direction M, and an angle between the moving direction M and the striking direction S is smaller than 90 degrees.

In the present embodiment, the safety mechanism includes a safety switch 51 and an abutting portion 52. The safety switch 51 is preferably an auto reset switch and includes a first switch body 511 and a first trigger arm 512. The first switch body 511 is electrically connected to the trigger switch 42, and the first trigger arm 512 is pivotally connected to the first switch body 511. The safety switch 51 is disposed on the moving portion 21 of the handle 20. The abutting portion 52 is disposed on the main body 10. The safety switch 51 is located below the abutting portion 52. When the moving portion 21 of the handle 20 is at the original position, the first trigger arm 512 is pushed toward the first switch body 511 by the abutting portion 52 normally so that the first switch body 511 is activated normally to make the safety mechanism at the locking mode. When the moving portion 21 of the handle 20 is moved to the unlock position, the first trigger arm 512 is not pushed by the abutting portion 52 so that the first switch body 511 is not activated, and that the safety mechanism is at the unlock mode. However, the safety switch can be a light sensor switch or other types of switch. Specifically, the abutting portion 52 is a protrusion extending toward the handle 20.

The trigger switch 42 is preferably is a microswitch and includes a second switch body 421 and a second trigger arm 422. The second switch body 421 is electrically connected to the power mechanism 30, and the second trigger arm 422 is pivotally connected to the second switch body 421. The handle 20 has a trigger button 22 for pressing. When the trigger button 22 is not pressed, the second trigger arm 422 is remote from the second switch body 421 so that the second switch body 421 is not activated. When the trigger switch 42 is at the strikable state and the trigger button 22 is pressed to push the second trigger arm 422 toward the second switch body 421, the second switch body 421 is activated to drive the striking mechanism 41 to strike the at least one staple out. Preferably, the trigger button 22 is disposed on a face of the handle 20 facing the main body 10.

Besides, the electric stapler of the present invention can further include a warning mechanism. The warning mechanism includes a warning light 61 disposed on the handle 20 and electrically connected to the safety mechanism. The warning light 61 has different lighting modes when the safety mechanism is at the locking mode or the unlock mode to alarm the user. For example, when the safety mechanism is at the locking mode, the warning light 61 is off. When the safety mechanism is at the unlock mode, the warning light 61 is on. Alternatively, when the safety mechanism is at the locking mode, the warning light 61 emits blue light or green light. When the safety mechanism is at the unlock mode, the warning light 61 emits red light. Preferably, the warning light 61 is disposed on a face of the handle 20 opposite to the main body 10. That is, the warning light 61 is disposed on a position opposite to the striking direction S, or toward the user. Thus, the user is informed whether the safety mechanism is unlocked or not.

Specifically, the handle 20 is pivotally connected to the main body 10, and the moving portion 21 is located at an end of the handle 20 opposite to the pivot portion. When the handle pivots at a small angle, the moving portion 21 moves substantially linearly. When the handle 20 is pressed toward the main body 10, the moving portion 21 moves downward to trigger the safety mechanism. In other possible embodiment, the handle can be slidably disposed on the main body.

Besides, in the present embodiment, the power mechanism 30 includes an inlet port 31 and a circuit board 32. The inlet port 31 is adapted for connecting to a power source. The safety switch 51 and the trigger switch 42 are electrically connected to the circuit board 32 respectively. The warning light 61 is also electrically connected to the circuit board 32. That is, the safety switch 51 (more especially the first switch body 511), the trigger switch 42 (more especially the second switch body 421), and the warning light 61 are disposed on the circuit board 32 respectively and communicate each other via the circuit board 32.

Figure 4:
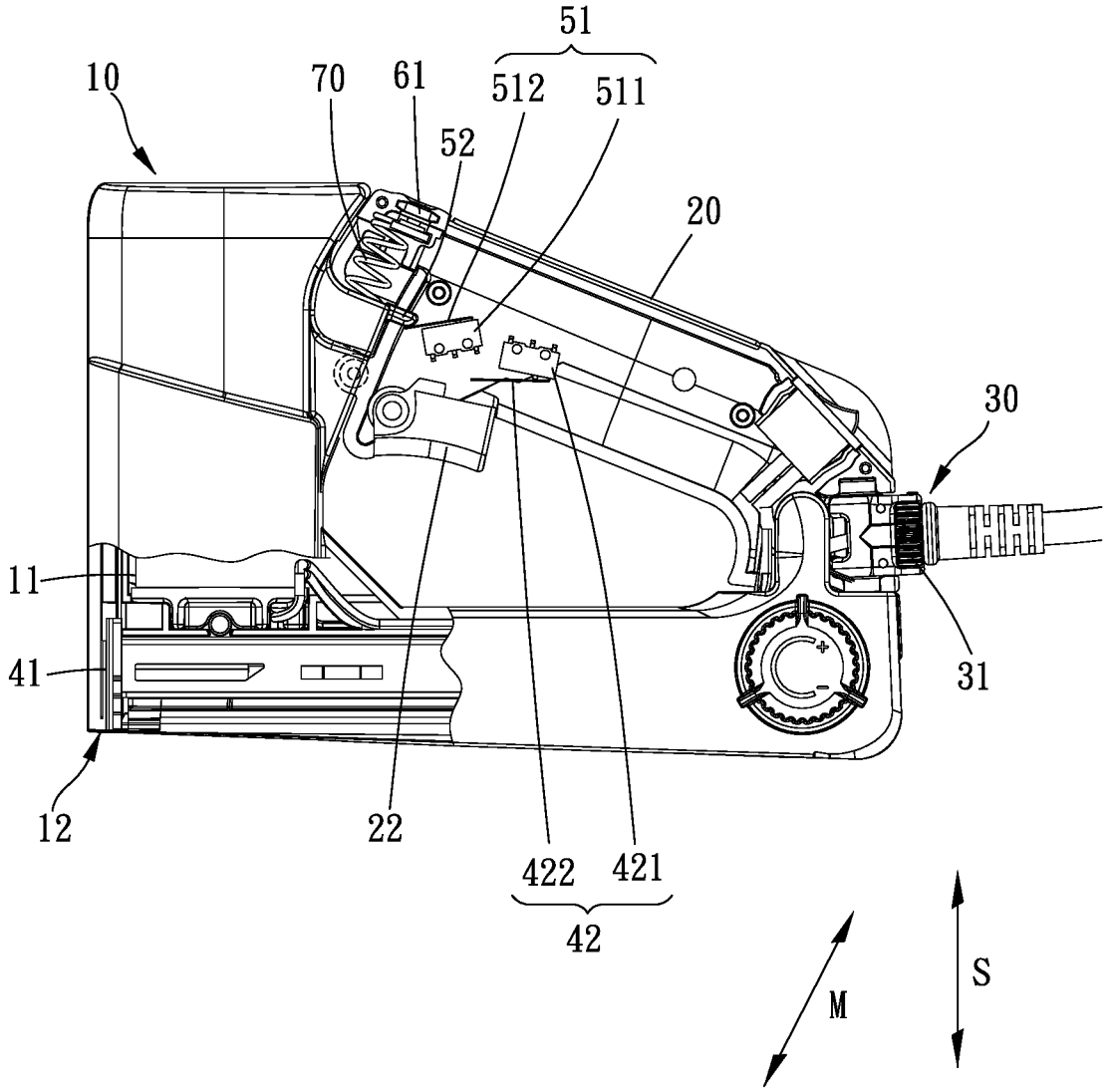
FIG. 4 is a profile of the present invention.
Figure 5:
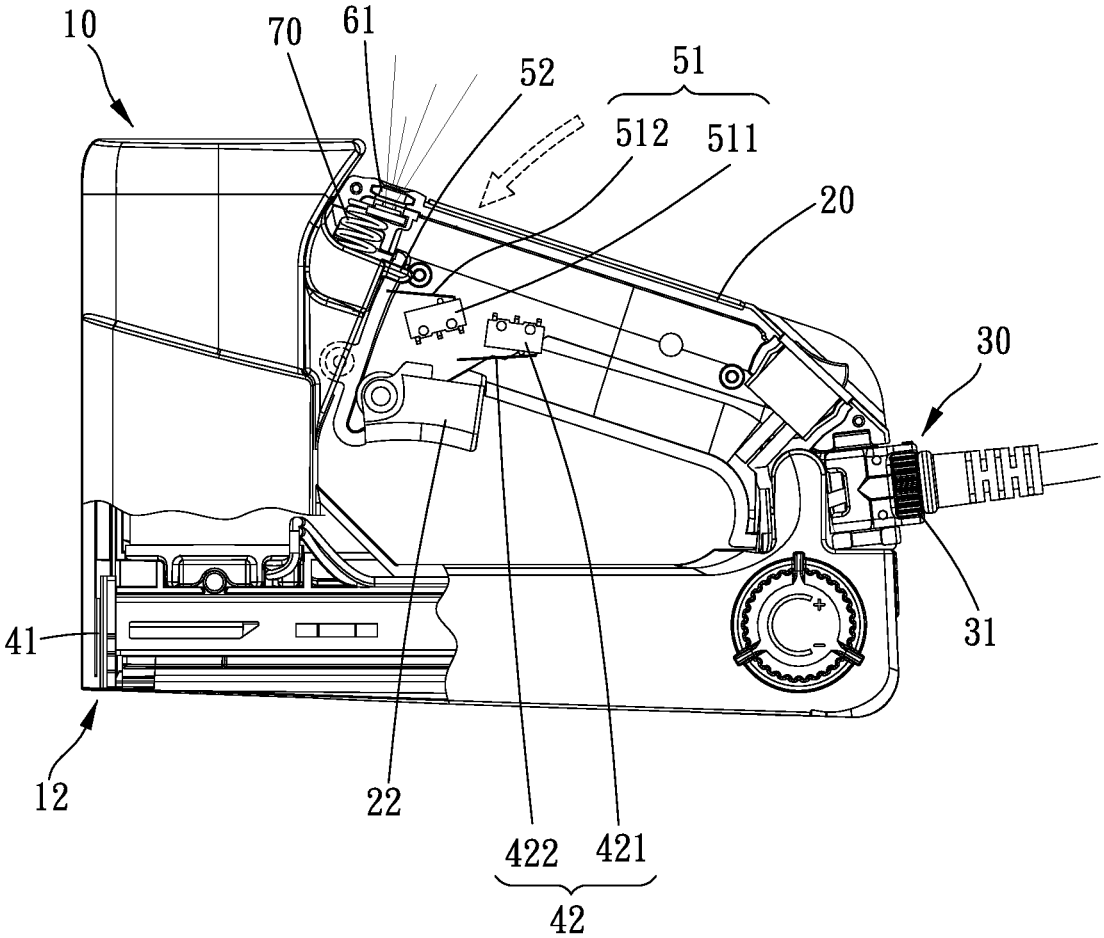
FIG. 5 and FIG. 6 are illustrations of operation of the present invention.
Figure 6:
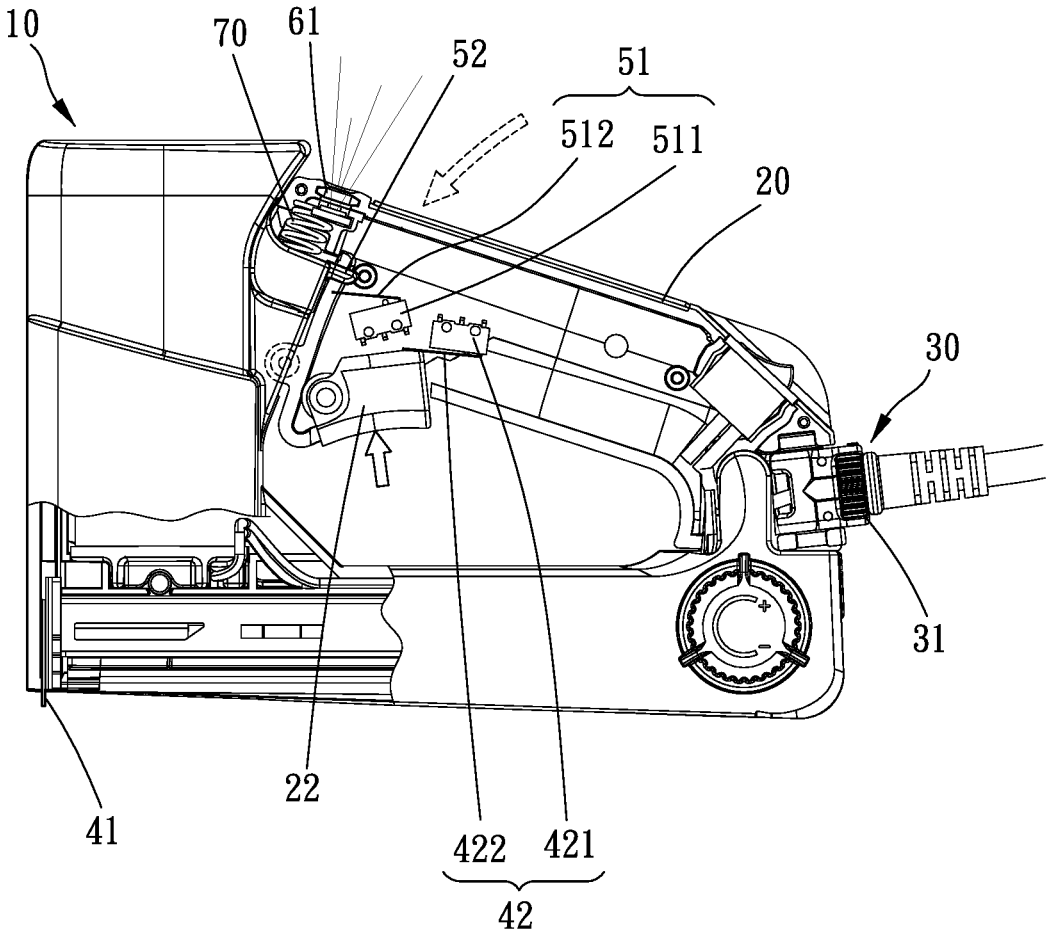

In use, when the handle 20 is not held by the user, the moving portion 21 is at the original position, and the safety switch 51 is at the locking mode, so the trigger switch 42 is also at the locking state. That is, even if the trigger button 22 is pressed, the trigger switch 42 is not triggered, and the striking mechanism 41 may not strike the staple out, as shown in FIG. 4. When the handle 20 is held by the user and the moving portion 21 is pushed to the unlock position, the safety mechanism is switched to the unlock mode to make the trigger switch 42 switch to the strikable state, and the warning light 61 is on, as shown in FIG. 5. At this time, when the trigger button 22 is pressed by the user, the striking mechanism 41 strikes the staple out, as shown in FIG. 6. When the handle 20 is released by the user, the moving portion 21 returns to the original position, and the safety mechanism is reset to the locking mode so that the trigger switch 42 is reset to the locking state to prevent from striking the staple out accidentally.

In other words, only when the handle 20 is pressed toward the main body 10 and the trigger button 22 is pressed, the staple can be struck out. When the handle 20 is not pressed to unlock the safety mechanism, the staple is not struck out even if the trigger button 22 is pressed. On the other hand, the direction of pressing the handle 20 is opposite to the direction of pressing the trigger button 22, so the trigger button 22 is difficult to be pressed accidentally when pressing the handle 20 to unlock.

In other possible embodiments, the electric stapler of the present invention includes a main body, a handle, a power mechanism, a striking assembly, and a safety mechanism.

The main body has a receiving space and a staple outlet. The receiving space communicates the staple outlet. The receiving space is adapted for receiving at least one staple. The handle is connected to the main body. The handle has a moving portion. The moving portion is movable between an original position and an unlock position with respect to the main body. The moving portion is located at the original position normally. The power mechanism is disposed on one of the main body and the handle. The striking assembly includes a striking mechanism and a trigger switch. The striking mechanism is arranged in the receiving space and is electrically connected to the power mechanism. The striking mechanism is adapted for striking the at least one staple out along a striking direction via the staple outlet. The trigger switch is arranged on the moving portion of the handle and is electrically connected to the striking mechanism to trigger the striking mechanism to strike the at least one staple. The striking mechanism has a strikable state and a locking state. The trigger switch is striggerable to drive the striking mechanism to strike the at least one staple out when the trigger switch is at the strikable state. The trigger switch is deactivated to be unable to strike the at least one staple out when the trigger switch is at the locking state. The safety mechanism is arranged on the handle. The safety mechanism is electrically connected to the trigger switch. The safety mechanism has a locking mode and an unlock mode. The trigger switch is at the locking state when the safety mechanism is at the locking mode, and the trigger switch is at the strikable state when the safety switch is at the unlock mode. When the moving portion of the handle is at the striking position and the trigger switch is at the strikable state, the trigger switch drives the striking mechanism to strike the at least one staple out. A direction from the original position toward the unlock position is defined as a moving direction, and an angle between the moving direction and the striking direction is smaller than 90 degrees.

In conclusion, the electric stapler of the present invention has the safety mechanism and the trigger button at different positions, and the direction of unlocking is opposite to the direction of pressing the trigger button. Thus, the staple can be prevented from being struck out accidently during unlocking. Besides, the spring between the handle and the main body can absorb the reaction force when striking the staple.

What is claimed is:

1. An electric stapler, including:

a main body, having a receiving space and a staple outlet, the receiving space communicating with the staple outlet, the receiving space being adapted for receiving at least one staple;

a handle, rotatably connected to the main body, the handle having a moving portion, the moving portion being movable between an original position and an unlock position with respect to the main body, the moving portion being located at the original position normally;

a power mechanism, disposed on one of the main body and the handle;

a striking assembly, including a striking mechanism and a trigger switch, the striking mechanism being arranged in the receiving space and being electrically connected to the power mechanism, the striking mechanism being adapted for striking the at least one staple out along a striking direction via the staple outlet, the trigger switch being arranged on the handle and being electrically connected to the striking mechanism to trigger the striking mechanism to strike the at least one staple, the striking mechanism having a strikable state and a locking state, the trigger switch being triggerable to drive the striking mechanism to strike the at least one staple out when the trigger switch is at the strikable state, the trigger switch being deactivated to be unable to strike the at least one staple out when the trigger switch is at the locking state;

a safety mechanism, arranged between the main body and the moving portion of the handle, the safety mechanism being electrically connected to the trigger switch, the safety mechanism being at a locking mode to make the trigger switch at the locking state when the moving portion of the handle is at the original position, the safety mechanism being at an unlock mode to make the trigger switch at the strikable state when the moving portion of the handle is at the unlock positon;

wherein a direction from the original position toward the unlock position is defined as a moving direction, an angle between the moving direction and the striking direction is smaller than 90 degrees;

wherein the handle is rotatable relative to the main body, the moving portion is movable with the handle, and a trigger button configured to trigger the trigger switch is mounted to the handle and movable with the handle.

2. The electric stapler of claim 1, wherein the safety mechanism includes a safety switch and an abutting portion, the safety switch is an auto reset switch and includes a first switch body and a first trigger arm, the first switch body is electrically connected to the trigger switch, the first trigger arm is pivotally connected to the first switch body, the safety switch is disposed on the moving portion of the handle, the abutting portion is disposed on the main body, the safety switch is located below the abutting portion; when the moving portion of the handle is at the original position, the first trigger arm is pushed by the abutting portion toward the first switch body so that the first switch body is triggered normally to make the safety mechanism is at the locking mode; when the moving portion of the handle is moved to the unlock position, the abutting portion leaves the first trigger arm so that the first switch body is not activated to make the safety mechanism is at the unlock mode.

3. The electric stapler of claim 2, the abutting portion is a protrusion extending toward the handle.

4. The electric stapler of claim 3, wherein the trigger switch is a microswitch and includes a second switch body and a second trigger arm, the second switch body is electrically connected to the power mechanism, the second trigger arm is pivotally connected to the second switch body; when the trigger button is not pressed, the second trigger arm is remote from the second switch body normally so that the second switch body is not activated; when the trigger switch is at the strikable state and the trigger is pressed to make the second trigger arm move toward the second switch body, the second switch body is triggered to drive the striking mechanism to strike the at least one staple out; the trigger button is disposed on a face of the handle facing the main body;

the electric stapler further includes a warning mechanism, the warning mechanism includes a warning light disposed on a face of the handle opposite to the main body, the warning light is electrically connected to the safety mechanism, the warning light is off when the safety mechanism is at the locking mode, the warning light is on when the safety mechanism is at the unlock mode; the handle is pivotally connected to the main body, the moving portion is located at an end of the handle opposite to a pivot portion of the handle; a spring is biased between the main body and the handle so that the handle normally retains at the original position; the power mechanism includes an inlet port and a circuit board, the inlet port is adapted for connecting to a power source, the safety switch and the trigger switch are electrically connected to the circuit board thereon respectively, the warning light is also electrically connected to the circuit board.

5. The electric stapler of claim 1, wherein the trigger switch is a microswitch and includes a second switch body and a second trigger arm, the second switch body is electrically connected to the power mechanism, the second trigger arm is pivotally connected to the second switch body; when the trigger button is not pressed, the second trigger arm is remote from the second switch body normally so that the second switch body is not activated; when the trigger switch is at the strikable state and the trigger is pressed to make the second trigger arm move toward the second switch body, the second switch body is triggered to drive the striking mechanism to strike the at least one staple out.

6. The electric stapler of claim 5, wherein the trigger button is disposed on a face of the handle facing the main body.

7. The electric stapler of claim 1, further including a warning mechanism, the warning mechanism including a warning light disposed on a face of the handle opposite to the main body, the warning light is electrically connected to the safety mechanism, the warning light having various lighting modes when the safety mechanism is at the locking mode or the unlock mode.

8. The electric stapler of claim 1, wherein the handle is pivotally connected to the main body, the moving portion is located at an end of the handle opposite to a pivot portion of the handle.

9. The electric stapler of claim 1, wherein the handle is slidably disposed on the main body.

10. An electric stapler, including:

a main body, having a receiving space and a staple outlet, the receiving space communicating with the staple outlet, the receiving space being adapted for receiving at least one staple;

a handle, rotatably connected to the main body, the handle having a moving portion, the moving portion being movable between an original position and an unlock position with respect to the main body, the moving portion being located at the original position normally;

a power mechanism, disposed on one of the main body and the handle;

a striking assembly, including a striking mechanism and a trigger switch, the striking mechanism being arranged in the receiving space and being electrically connected to the power mechanism, the striking mechanism being adapted for striking the at least one staple out along a striking direction via the staple outlet, the trigger switch being arranged on the moving portion of the handle and being electrically connected to the striking mechanism to trigger the striking mechanism to strike the at least one staple, the striking mechanism having a strikable state and a locking state, the trigger switch being triggerable to drive the striking mechanism to strike the at least one staple out when the trigger switch is at the strikable state, the trigger switch being deactivated to be unable to strike the at least one staple out when the trigger switch is at the locking state;

a safety mechanism, arranged on the handle, the safety mechanism being electrically connected to the trigger switch, the safety mechanism having a locking mode and an unlock mode, the trigger switch being at the locking state when the safety mechanism is at the locking mode, the trigger switch being at the strikable state when the safety switch is at the unlock mode, wherein when the moving portion of the handle is at the striking position and the trigger switch is at the strikable state, the trigger switch drives the striking mechanism to strike the at least one staple out;

wherein a direction from the original position toward the unlock position is defined as a moving direction, an angle between the moving direction and the striking direction is smaller than 90 degrees;

wherein the handle is rotatable relative to the main body, the moving portion is movable with the handle, and a trigger button configured to trigger the trigger switch is mounted to the handle and movable with the handle.

* * * * *